US006499709B1

(12) United States Patent
Parent

(10) Patent No.: US 6,499,709 B1
(45) Date of Patent: Dec. 31, 2002

(54) BRACKET FOR SUPPORTING A POWERED WINDOW SHADE

(75) Inventor: Herman J. Parent, Winsted, CT (US)

(73) Assignee: Seitz Corporation, Torrington, CT (US)

( * ) Notice: Subject to any disclaimer, the term of this patent is extended or adjusted under 35 U.S.C. 154(b) by 0 days.

(21) Appl. No.: 09/922,571

(22) Filed: Aug. 6, 2001

(51) Int. Cl.[7] ..... A47H 1/10

(52) U.S. Cl. ..... 248/267; 160/903; 160/323.1; 16/319; 16/374

(58) Field of Search ..... 248/266–272, 248/254, 257, 258, 259, 289.11, 290.1; 160/903, 127, 323.1, 324, 325, 326, 368.1; D8/363, 366, 327–329; 16/266, 207, 371, 374

(56) References Cited

U.S. PATENT DOCUMENTS

| | | | | | |
|---|---|---|---|---|---|
| 1,114,203 | A | * | 10/1914 | Taiz | 248/272 |
| 1,473,291 | A | * | 11/1923 | Harsh | 248/271 |
| 1,526,916 | A | * | 2/1925 | Kyde | 211/175 |
| 2,001,864 | A | * | 5/1935 | Benjinsohn | 248/267 |
| 2,474,414 | A | * | 6/1949 | Cavalier | 248/257 |
| 2,487,648 | A | * | 11/1949 | Green | 248/267 |
| 2,842,264 | A | * | 7/1958 | Larson | 206/499 |
| 3,329,385 | A | * | 7/1967 | Dietsch | 211/96 |
| 4,077,597 | A | * | 3/1978 | Greig | 248/289.11 |
| 4,131,259 | A | * | 12/1978 | Franks | 211/75 |
| 4,249,714 | A | * | 2/1981 | Boyle | 248/254 |
| 5,054,723 | A | * | 10/1991 | Arnold | 248/65 |
| 5,259,091 | A | * | 11/1993 | Mordick | 16/262 |
| 5,791,018 | A | * | 8/1998 | Yoshinobu | 16/374 |
| 6,045,103 | A | * | 4/2000 | Costa et al. | 211/119.06 |

FOREIGN PATENT DOCUMENTS

| | | | | |
|---|---|---|---|---|
| DE | 175134 | * | 9/1906 | 160/325 |
| GB | 19805 | * | 9/1905 | 248/271 |

* cited by examiner

*Primary Examiner*—Ramon O. Ramirez
*Assistant Examiner*—Jon Szumny
(74) *Attorney, Agent, or Firm*—Dallett Hoopes

(57) ABSTRACT

The bracket comprising an L-shaped mount defined by perpendicular plates having top and bottom bridging walls apertured in vertical alignment, the bottom wall formed with a blocking surface. The bracket also comprises a leaf plate having aligned upward and downward ears which pivot in the respective apertures, and the dimensions of the plate permit some vertical movement of the plate so that it can clear the blocking surface. The plate has a perpendicular flat tongue adapted to slip into a slot at one end of the shade to immobilize a portion of the power unit. The blocking surface keeps the plate from swinging open.

5 Claims, 2 Drawing Sheets

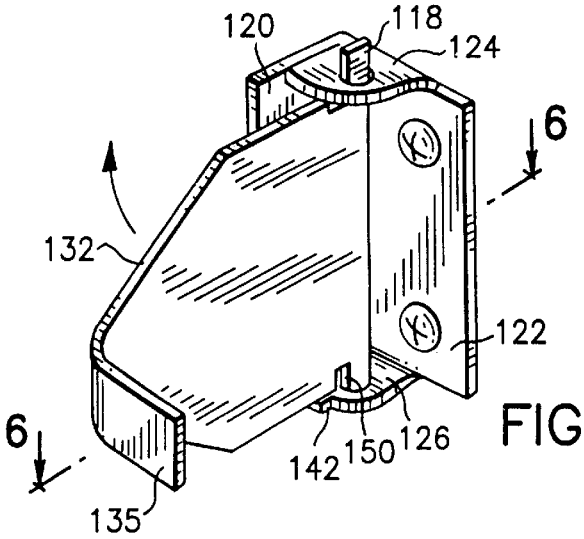
FIG.5
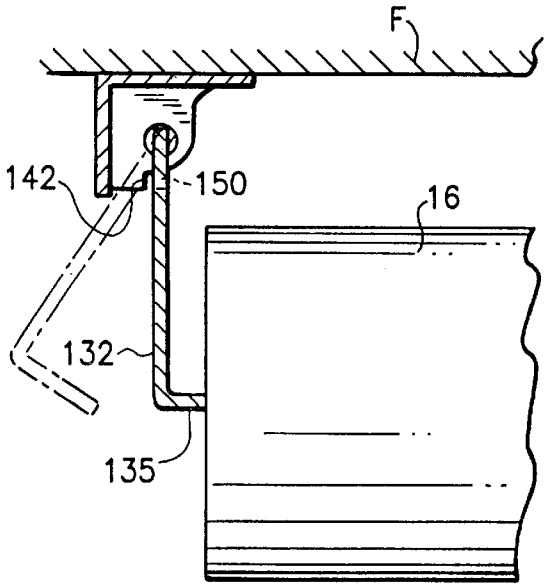
FIG.6
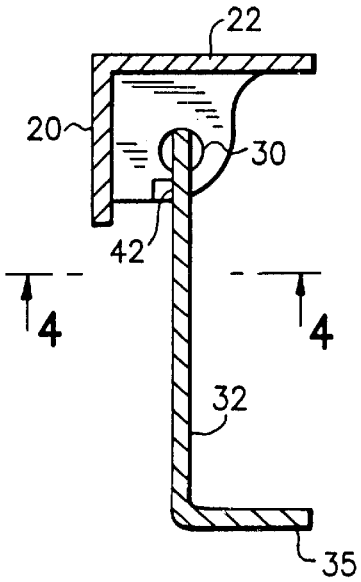
FIG.3
FIG.4
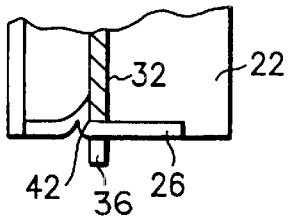

BRACKET FOR SUPPORTING A POWERED WINDOW SHADE

FIELD OF THE INVENTION

This invention relates to a bracket for supporting a powered window shade. More specifically, this invention relates to such a bracket having means to immobilize a portion of the power drive for the shade.

BACKGROUND OF THE INVENTION

The prior art discloses a number of roller-type window shades having internal means for powering them up or down. The power means have generally had a portion anchored to a stationary support. Generally the anchoring has been done by a fixed bracket attached to the window frame. Such arrangements have not easily permitted the removal of the shade without the use of tools.

SUMMARY OF THE INVENTION

The present invention is a bracket for mounting a roller shade having an internal power unit. The bracket comprises an L-shaped mount defined by perpendicular plates having top and bottom connector walls apertured in alignment, the bottom wall having a blocking surface in the form of a rib, for instance. The bracket also comprises a leaf plate having at one end aligned upward and downward ears which pivot in the respective apertures in the mount. The plate is dimensioned so that there is clearance to move up and down in the mount as the ears slide vertically in the apertures. The plate has a perpendicular flat tongue adapted to slip into and engage a slot in the end of the power unit to secure it from turning. In that engaged position the plate is blocked from swinging open by the blocking surface. Only when the plate is raised does it clear the surface and is free to pivot.

BRIEF DESCRIPTION OF THE DRAWINGS

Further objects and features of the invention will be clear to those skilled in the art from a review of the following specification and drawings, all of which present a non-limiting form of the invention. In the drawings:

FIG. 3 is a sectional view taken on the line 3—3 of FIG. 2;

FIG. 4 is a fragmentary sectional view taken on the line 4—4 of FIG. 3;

FIG. 5 is a view similar to FIG. 2 but of a modification having a different form of blocking surface. The plate is shown raised to permit pivoting; and FIG. 6 is a sectional view taken on the line 6—6 of FIG. 5 with the leaf shown in phantom in open position.

DESCRIPTION OF THE PREFERRED EMBODIMENT

Figure 1:
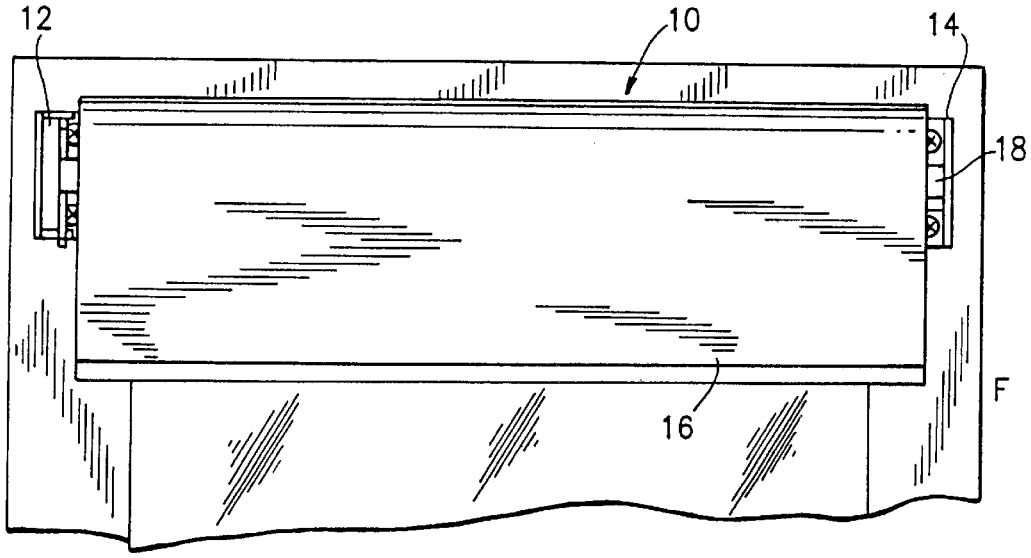
FIG. 1 is a front view of a power roller shade embodying the invention installed in a window frame.

A roller shade assembly is shown in FIG. 1 and generally designated 10. It is held on a window frame F by a leftward bracket 12 and a rightward bracket 14. The shade 10 comprises fabric or other flexible web 16 wound on a tube (not shown) containing a drive unit. At its leftward end the drive unit presents a central slot while at the rightward end the tube has a fixed spindle 18 which is free to rotate in the apertured bracket 14.

Inside the tube is the power unit (not shown), the left end of which is formed with the slot as stated and the driven end of which is connected to the tube. Power supply and control wires extend into the leftward end of the shade roller for energizing the drive unit to drive the shade up or down.

Figure 2:
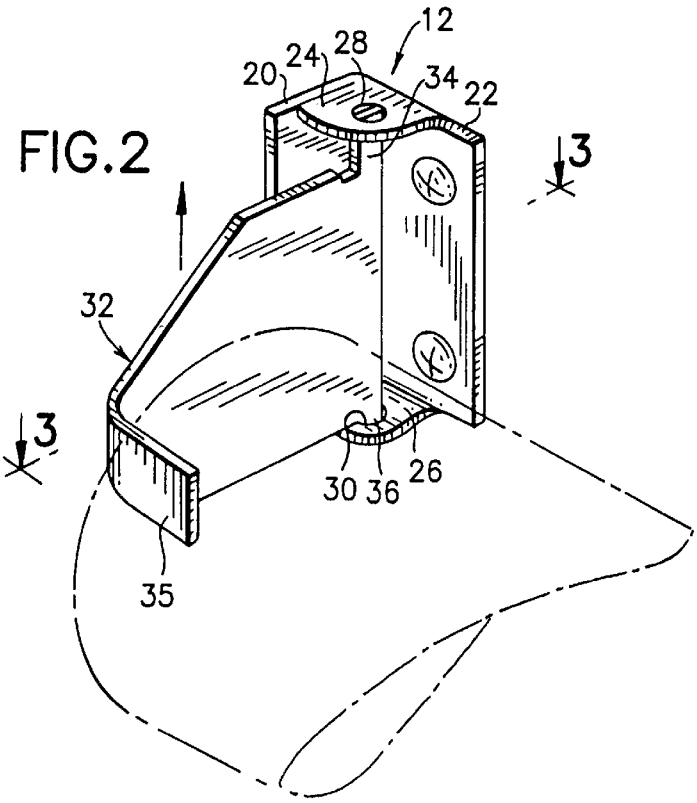
FIG. 2 is an enlarged perspective view of the leftward bracket shown in locked position. The shade is shown fragmentary in phantom lines.

The leftward bracket 12 (FIG. 2), comprises a mount defined by a pair of perpendicular plates 20 and 22 which are bridged by upper and lower walls 24, 26. The upper and lower walls 24, 26 are apertured at 28 and 30 in alignment. The pivoted leaf plate 32 is formed with upwardly and downwardly extending ears 34 and 36 respectively. These ears extend into the apertures 28 and 30 respectively and permit the pivoting of the leaf plate 32 when it is raised, to be explained. At its distal end the leaf is formed with a perpendicular tongue 35.

The lower wall 26 (FIG. 4) is formed with a blocking surface 42 which extends up from the top surface of the lower wall. With the leaf plate 32 in the down position shown in FIG. 2 —disposed downwardly with respect to the mount—the leaf plate 32 is blocked from swinging open by surface 42 and is held in position as shown. When as in removing the shade from its mount, rearward movement of the leaf plate 32 is necessary, it is a simple matter to raise the leaf so that the ears 34, 36 move upwardly in their respective apertures 28, 30, and the lower edge of the leaf plate adjacent the ear 36 clears the blocking surface 42 so that the leaf plate may be swung open away from the roller (phantom lines).

In operation, with the roller shade in place and the bracket and spindle 14, 18 properly engaged, the leaf plate 32 may be swung from its phantom line position of FIG. 6 to the solid line position shown. In this position, the tongue 35 slips into the slot (not shown) at the leftward end of the power unit to anchor that end from rotation. When the drive is energized, the other end of the power unit drives the roller shade tube (not shown).

In the FIGS. 5, 6 embodiment, using the same reference numbers augmented by 100, the blocking surface 142 is in the form of an outwardly extending detent 142 which extends outward from the curve of the wall 126. The lower edge of the plate 132 is formed with a relief 150 to accommodate the wall 126. Thus, when the plate 132 is down, the lower portion of the plate 132 is blocked from opening by the blocking surface 142. Here again, however, the opening of the plate 123 is achieved by simply raising the plate so that the lower end of the plate clears the blocking surface 142.

Further variations in the invention are possible. Thus, while the invention has been shown in only a pair of embodiments, it is not so limited but is of a scope defined by the following claim language which may be broadened by an extension of the right to exclude others from making, using or selling the invention as is appropriate under the doctrine of equivalents.

What is claimed is:

1. For a roller shade having an internal power unit a support bracket comprising:

a. an L-shaped mount defined by perpendicular vertical plates having top and bottom bridging walls apertured in alignment, the bottom wall having a blocking surface, b. a leaf plate comprising a plate having aligned upward and downward ears which pivot in the respective apertures and permit some vertical movement of the plate, the leaf having a perpendicular flat tongue adapted to slip into a slot in one end of the shade to immobilize a portion of the power unit.

2. The roller shade as claimed in claim 1 wherein the blocking surface is in the form of an upward detent in the bottom bridging wall.

3. The roller shade as claimed in claim 1 wherein the blocking surface is in the form of an outward jutting shape on the bottom bridging wall and the bottom edge of the plate is relieved to accommodate part of the bottom bridging wall.

4. A roller shade assembly comprising:

(a) a roller shade having an internal power unit, and (b) a roller shade support bracket comprising a mount having vertically aligned apertures therein and a vertically disposed leaf plate having vertically aligned upward and downward ears pivotally disposed in the apertures, the leaf plate being vertically moveable in the mount and pivotable about a vertical axis in the mount, the leaf plate having a distal end formed with a perpendicular flat tongue adapted when in a closed position to extend into a slot in one end of the shade to immobilize a portion of the power unit, the mount having a blocking surface thereon which precludes swinging of the plate away from closed position.

5. A roller shade as claimed in claim 4 wherein the blocking surface extends upward from a surface of the mount.

* * * * *